United States Patent [19]

Brown

[11] 4,258,608

[45] Mar. 31, 1981

[54] IN-LINE SNUBBER FOR USE WITH BRAIDED CORDAGE

[76] Inventor: John L. Brown, 2225 Bridlewood Dr., Rancho Cordova, Calif. 95670

[21] Appl. No.: 11,802

[22] Filed: Feb. 14, 1979

[51] Int. Cl.[3] ..... D04C 1/12; B63B 21/00; F16F 1/36

[52] U.S. Cl. ..... 87/6; 87/2; 87/11; 114/215; 267/69; 267/148

[58] Field of Search ..... 87/5–11, 87/1, 2; 267/134, 135, 148, 69; 114/215

[56] References Cited

U.S. PATENT DOCUMENTS

| | | | |
|---|---|---|---|
| 1,930,766 | 10/1933 | Moore | 87/6 |
| 2,111,639 | 3/1938 | Petersen | 87/6 |
| 2,291,568 | 7/1942 | Balch | 87/6 |
| 2,328,500 | 8/1943 | Salsas | 87/6 X |
| 3,421,405 | 1/1969 | Logrippo | 87/6 |
| 3,481,245 | 12/1969 | Kamitani | 87/6 |
| 3,486,409 | 12/1969 | Powell | 87/6 |
| 3,936,336 | 2/1976 | Phillips | 87/6 X |
| 4,036,101 | 7/1977 | Burnett | 87/8 |

FOREIGN PATENT DOCUMENTS

| | | | |
|---|---|---|---|
| 341561 | 9/1904 | France | 87/6 |

*Primary Examiner*—John Petrakes
*Attorney, Agent, or Firm*—Blair, Brown & Kreten

[57] ABSTRACT

Disclosed herein is a snubbing device for use with traditional braided cordage. Traditional braided cordage exhibits a certain elasticity when tensioned by having the longitudinal axis of the braided cordage pulled in such a manner that the braid and resulting diameter constricts itself. In a double braided environment, an outer braid would constrict upon an inner braid, which would in turn constrict upon itself. A resilient elastic insert is provided within the inner core thereof, thereby causing the inner braid to constrict thereon.

3 Claims, 6 Drawing Figures

FIG. 1
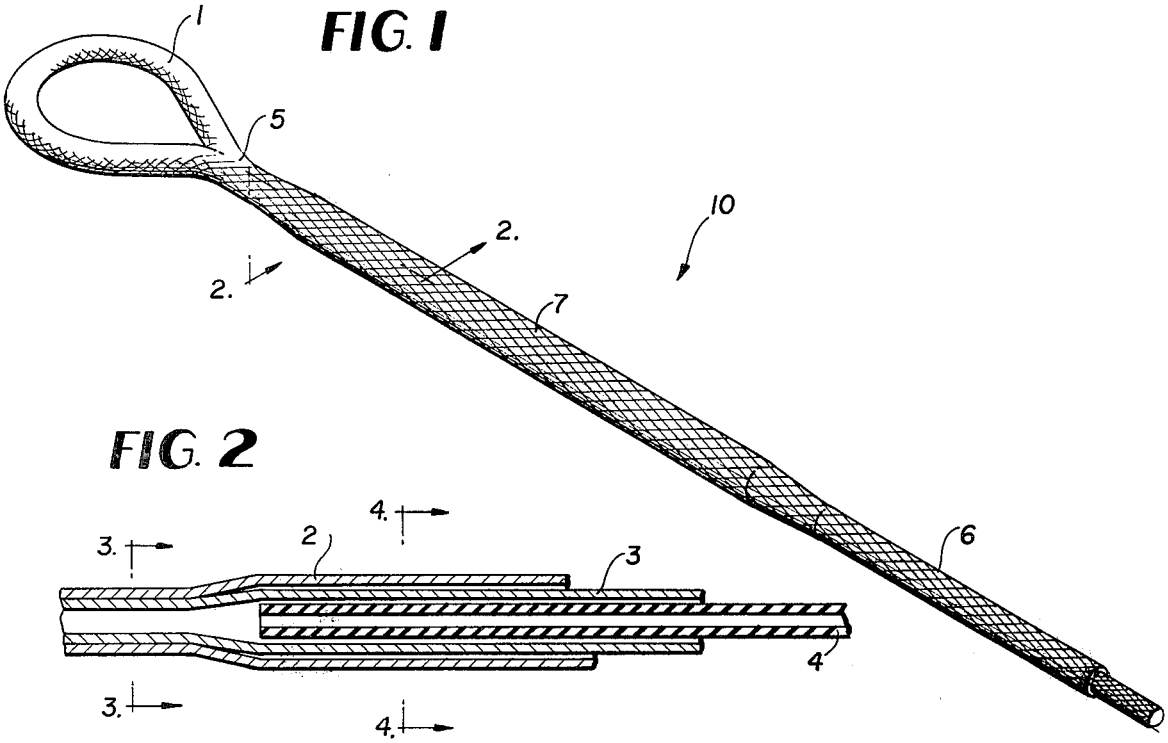
FIG. 2
FIG. 3
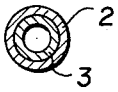
FIG 4
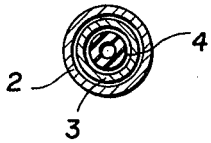
FIG. 5
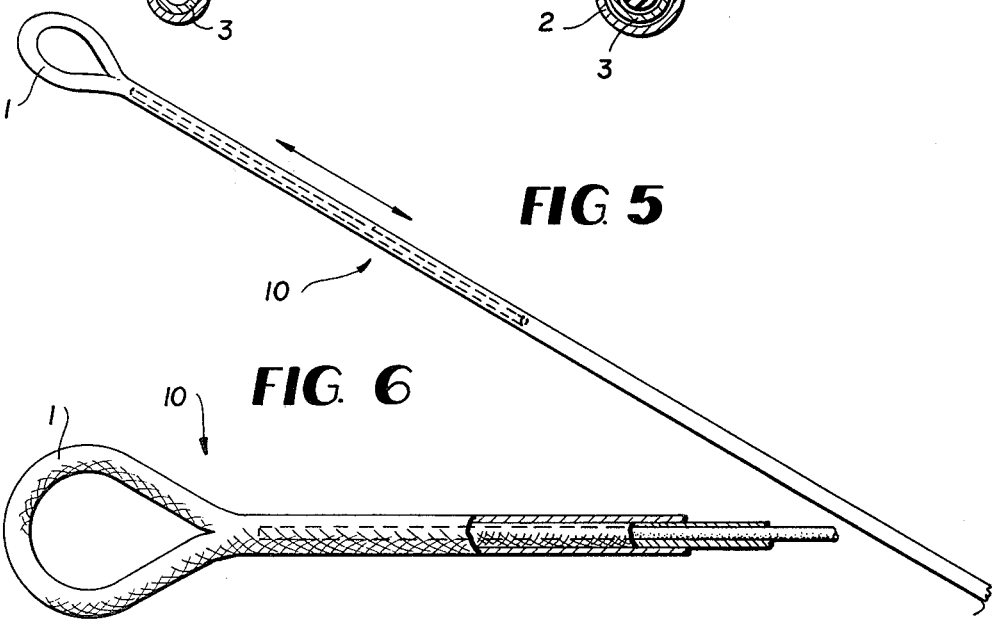
FIG. 6

IN-LINE SNUBBER FOR USE WITH BRAIDED CORDAGE

BACKGROUND OF THE INVENTION

The following detailed description of the invention relates generally to braided cordage used for towing and tethering, for example in the nautical environment.

The following patents are listed in two catagories generally directed towards similar physical attributes and comprise the state of art as known to applicant: U.S. Pat. No. 1,509,012, Whiting, U.S. Pat. No. 3,353,817, Bollinger, U.S. Pat. No. 2,878,013, Piodi, and U.S. Pat. No. 4,022,450, Smith.

Each of these references relates to externally attached devices which in all cases caused chafing of the rope or line at the point to which it is attached, and being exposed to the elements, will suffer and lose effectiveness from rust and other weathering. The following patents describe generally stretchable cordage, but are quite different from the instant application: U.S. Pat. No. 2,737,075, Poirier et al, U.S. Pat. No. 3,130,630, Dawes and U.S. Pat. No. 2,887,005, Fromm.

These samples of stretchable cordage have several characteristics which preclude its use as a mooring line or tow rope:

The elasticity of stretchable cordage extends over its entire length, making it impossible to knot or tie or splice for mooring or towing. Additionally, it is subject to aggravated chafing at all points of contact with cleats, fairleads, and other hard surfaces as it stretches under tension.

The major characteristic of stretchable cordage is its elasticity. A mooring line is required to control the motion of the moored boat or craft. Stretchable cordage as a boat mooring, for example, would provide so little control that the boat would be in danger of striking other boats or docks in the vicinity.

It is apparent therefore, that the use of a stretchable cord or rope in which the elasticity exists along the entire extent of the rope will not provide the salubrious benefits according to the present invention which is characterized in that only a small portion of a conventional braided line be provided with an elastic cord therein so as to provide a comparatively limited range of elasticity and give.

OBJECTS AND SUMMARY OF THE INVENTION

Therefore, an object of this invention contemplates providing a rope of braided configuration which can be provided along a discrete portion thereof with an elastic core so as to alter the stretchability of that segment.

It is another object of this invention to provide a rope of the character described above in which the elastic core is so inserted that the braid of the rope is not interrupted by the insertion of the elastic member.

It is yet another object of this invention to provide an elastic core for so called double-braided cord without interrupting either braid.

An object and result thereof contemplates providing a rope for use in mooring or towing which does not impose a severe sudden loading upon the tethered components when the elastic limits of the cord have been reached, but rather provides a general increasing resistance to the pull thereagainst so as to dampen the shock load that results from the rope having been stretched.

These and other objects will be made manifest when considering the following detailed specification and claims.

BRIEF DESCRIPTION OF THE DRAWINGS

FIG. 1 depicts a perspective view of a portion of the rope having the apparatus according to the present invention inserted therein;

FIG. 2 is a sectional view taken along lines 2—2 of FIG. 1;

FIG. 3 is a sectional view taken along lines 3—3 of FIG. 2;

FIG. 4 is a sectional view taken along lines 4—4 of FIG. 2;

FIG. 5 is a perspective view of the rope shown in FIG. 1 in an extended position; and FIG. 6 is a similar view of that shown in FIG. 1 in which a portion of the outer covering has been removed.

DESCRIPTION OF THE PREFERRED EMBODIMENT

Referring to the drawings now, wherein like reference numerals refer to like parts throughout the several figures reference numeral 10 is directed to the in-line snubber according to the present invention.

The snubber, it will be observed, does not extend the entire length of the cord, but rather encompasses only a small discrete portion thereof, and the magnitude thereof is selectable so that various degrees of elasticity can be incorporated within the rope as desired. FIG. 1 shows an eyelet 1 suitable for surrounding a cleat or similar other such mooring device which terminates in a neck portion 5 not having the elastic insert. The bulbous central portion 7 having the insert, terminates thereafter to a tapering area followed by the normal diameter of the double braided cord 6 as shown in the drawings. The elastomeric central portion 4 is surrounded by a first braided area 3 which in turn underlies a second braided portion 2, and the structure of the weave of these braids is such that elongation of the rope causes the braid to constrict or compress and thereby reduce the effective diameter thereof. With the absence of the elastomeric insert 4, the outer braid 2 constricts upon the inner braid 3 which in turn constricts upon itself. With the inclusion of the elastomeric core portion 4, the braided area 3 constricts thereupon and provides a degree of resiliency not provided for in the regular braided structure. It should therefore be apparent, that since only a small portion of the rope has the insert therein, the elongation tends to take place solely at the area that contains the rubber insert since this area is more sensitive to the tensile loads placed thereon.

A method for inserting the elastic core comprises the following steps; the outer cover 2 is opened thereby exposing the inner core 3, but the opening is made by separating the braids and not physically severing the fabric, so that a general relaxation takes place of the weave and the structural integrity of the fibers comprising the braid are not in any way cut or spliced. After the braid has been loosened on the outer portion, by use perhaps of a marlin spike or an awl, the inner braid is exposed and pulled out of the outer braid for a length approximately $1\frac{1}{2}$ times the length of the tubular insert to be placed therein. The inner braid is thereafter opened and a hollow metal tube is threaded with the elastic member to be disposed therein, and is placed within the central braid. The elastic core can thereby be worked into the braid without damaging any of the outer fiber and the elastic core is "milked" into the inner braid. Similarily, the outer braid thereafter has milked therein the inner braid with the core so that the last formed section is of slightly greater diameter than the remainder of the line. Thereafter, the line is smoothed and the area chosen for separating the braids is smoothed and tensioned so as to approximate the briaded configuration prior to insertion of the tube. The metal tube is always removed after insertion.

It is important that by utilization of this method, the line is not cut or severed in any way and therefore remains intact and retains all of its original strength. And that the insert does not stretch to provide the elasticity but is compressed as the line is pulled tight. In this manner, an optimum force for a given length is produced. This exists because the nature of the braid causes constriction thereon and the resulting elasticity of the central core section provides a beneficial damping. Although the figures show that the core element 4 is hollow, it is equally evident that the core could be solid, and whereas only two overlying braids have been shown, it should be evident that fewer or greater number of overlying braids are contemplated as being a part of this invention, and the foregoing is merely illustrative. When used in a towing environment, this elastic section can be placed substantially medially between that which is being towed and the motive force that provides the towing. In a mooring situation, the elastic section can be placed nearer the eyelet 1, but should be of sufficient distance away whereby the elastic section is physically removed from any cleat or anchoring device.

Having thus described the preferred embodiment of the invention it should be apparent that numerous structural modifications and adaptations may be resorted to without departing from the spirit of the invention.

What is claimed is:

1. An in-line snubber for use as a tow or mooring line comprising a length of cordage having end portions and a central core of elastomeric material extending along a minor portion of the length of said cordage between said end portions and at least one outer sleeve of braided material, said outer braided sleeve being expanded radially outward in the area of said central core from a relaxed condition to define a central bore for accommodating said central core and for gripping engagement with the outer surface of said central core whereby elongation of said cordage is yieldingly opposed with generally increasing resistance by the attendant constriction of said sleeve on said core and the elasticity of said core.

2. An in-line snubber in accordance with claim 1 wherein a pair of said outer sleeves of braided material are provided, said pair of outer sleeves being disposed on said central core in overlying, concentric relationship.

3. An in-line snubber in accordance with claim 2 wherein said central core comprises a tube.

* * * * *